US007150662B1

(12) United States Patent
Janitz

(10) Patent No.: US 7,150,662 B1
(45) Date of Patent: Dec. 19, 2006

(54) WATERCRAFT DOCKING SYSTEM AND PROPULSION ASSEMBLY

(75) Inventor: Mikel E. Janitz, Collinsville, OK (US)

(73) Assignee: Brunswick Corporation

( * ) Notice: Subject to any disclaimer, the term of this patent is extended or adjusted under 35 U.S.C. 154(b) by 0 days.

(21) Appl. No.: 11/029,679

(22) Filed: Jan. 5, 2005

(51) Int. Cl.
*B63H 25/42* (2006.01)
*B63H 21/17* (2006.01)
*B63H 5/08* (2006.01)
*B63H 5/125* (2006.01)

(52) U.S. Cl. ..... 440/6; 440/7; 440/53; 114/144 RE; 114/144 A

(58) Field of Classification Search ..... 114/144 R, 114/150, 151, 144 RE, 144 A, 144 B, 144 E; 440/6, 7, 53, 63; 248/640–643
See application file for complete search history.

(56) References Cited

U.S. PATENT DOCUMENTS 2,213,520 A * 9/1940 Gentry ..... 440/7
3,131,665 A * 5/1964 Kiekhaefer ..... 114/283
4,734,066 A * 3/1988 Burgess ..... 440/6
5,022,987 A * 6/1991 Wells ..... 210/173
5,131,875 A * 7/1992 Lee ..... 440/7
5,509,369 A 4/1996 Ford et al.
5,632,217 A 5/1997 Ford et al.
5,662,505 A * 9/1997 Spriggs ..... 440/6
5,842,895 A 12/1998 DeVito, Jr.
5,859,517 A 1/1999 DePasqua
5,892,338 A 4/1999 Moore et al.
6,132,267 A * 10/2000 Campbell ..... 440/6
6,142,841 A 11/2000 Alexander, Jr. et al.
6,213,821 B1 * 4/2001 Bernloehr et al. ..... 440/6
6,234,853 B1 5/2001 Lanyi et al.
6,311,634 B1 11/2001 Ford et al.
6,325,683 B1 12/2001 Yocom
6,468,117 B1 10/2002 Healey
6,520,813 B1 2/2003 DeVito, Jr.
6,672,236 B1 * 1/2004 Pinsof ..... 114/151
6,799,528 B1 * 10/2004 Bekker ..... 114/151
6,802,749 B1 * 10/2004 Justus ..... 440/6
6,848,382 B1 * 2/2005 Bekker ..... 114/144 B

FOREIGN PATENT DOCUMENTS

JP 52047295 A * 4/1977
JP 62289499 A * 12/1987
JP 04185597 A * 7/1992
JP 10059291 A * 3/1998
JP 2004161184 A * 6/2004

* cited by examiner

*Primary Examiner*—Ajay Vasudeva
(74) *Attorney, Agent, or Firm*—Fellers, Snider, et al.

(57) ABSTRACT

An improved docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

31 Claims, 3 Drawing Sheets

WATERCRAFT DOCKING SYSTEM AND PROPULSION ASSEMBLY

FIELD OF THE INVENTION

The present invention relates to docking systems, watercraft having docking systems installed thereon, and propulsion assemblies adaptable for use in watercraft docking systems.

BACKGROUND OF THE INVENTION

A need exists for a more effective and versatile system for docking pontoon boats, large deck boats, deep "V" boats, amphibious airplanes, floatplanes, and other watercraft and for maneuvering such watercraft in tight situations. A need particularly exists for such a system which can be conveniently installed on existing watercraft, preferably without the need for making any significant structural modifications to the hull or pontoons of the watercraft, and which can be readily adapted for trolling or other operations. A need further exists for a system of this type wherein the system propulsion units can be conveniently moved out of the water to stowed positions such that they will not interfere with the operation of the primary propulsion system of the watercraft.

Pontoon boats and other watercraft commonly have large and/or high powered propulsion systems (e.g., outboard motors, inboard motors, or stern drive systems) which are well suited for travel in open water. However, such propulsion systems typically are not highly maneuverable at low speeds and/or in tight or congested locations. Consequently, they can be difficult to use when docking the watercraft, particularly in high traffic areas or under adverse conditions such as high winds or strong currents. As a result, docking the watercraft can require considerable time and several attempts and can present a significant risk for equipment damage or personal injury.

In U.S. Pat. No. 6,234,853, a system is provided which seeks to enhance the maneuverability of the primary propulsion system of a watercraft for docking operations. To employ the system of U.S. Pat. No. 6,234,853, the boat's primary propulsion system must consist of at least two rearward primary propulsion units attached to the transom of the watercraft. The two primary propulsion units can be outboard motors, inboard motors, or stern drive systems and must be operable in both forward and reverse. The system of U.S. Pat. No. 6,234,853 comprises an engine control unit which calculates thrust requirements for each of the primary propulsion units responsive to the operator's control commands and then controls and changes the speed, pitch, and/or direction of each of the primary propulsion units in accordance therewith.

Of greater interest to the present invention, other docking systems developed heretofore have not depended upon the primary propulsion unit(s) of the watercraft. Unfortunately, such docking systems typically (a) have required that the watercraft have a specially adapted hull, (b) have required the use of special docking motors which fit in the hull, and (c) have not been suitable for installation on an existing craft. For example, U.S. Pat. No. 6,142,841 discloses a docking system wherein a plurality of propeller assemblies must be installed, in stationary position, in flow passageways or other recesses formed in the hull. The stationary propeller assemblies are operated in a coordinated manner for docking and maneuvering the craft. The entire disclosure of U.S. Pat. No. 6,142,841 is incorporated herein by reference. In one embodiment, flow conduits perpendicular to the longitudinal centerline of the craft are formed through the hull across the fore and aft ends thereof. In another embodiment, the docking system comprises one lateral flow passage through the front of the hull and two angled flow passages which are formed through the aft portion of the hull. In a third embodiment, stationary propeller assemblies are installed in a pair of curved side recesses formed in the fore portion of the hull and in an opposing pair of curved side recesses formed in the aft portion of the hull.

U.S. Pat. No. 6,325,683 discloses a docking system wherein four stationary propeller assemblies are installed in angled passageways or angled recesses formed in either the hull or the pontoons of a watercraft. The entire disclosure of U.S. Pat. No. 6,325,683 is incorporated herein by reference. The system utilizes either a radio frequency remote-control or a keypad control which is connected by an electrical cable. In response to the user's commands, the control system coordinates the operation of the four stationary propeller assemblies such that they are actuated individually or in combination as necessary to move the watercraft in a desired direction and manner.

In contrast to the special stationary propulsion assemblies required by the docking systems developed heretofore, U.S. Pat. No. 5,892,338 discloses a common trolling motor comprising: a steering head having a fixed tube extending from the bottom thereof, a rotatable tube or other rotatable column having a proximal end which is received in the control head and a distal end which projects from the distal end of the fixed tube; an electric propulsion motor and propeller assembly secured on the distal end of the rotatable column; an electrical cable extending through the rotatable tube from the control head to the propulsion motor for operating and for controlling the speed of the motor; a steering motor and gear assembly provided in the control head for turning the rotatable column, and thereby also turning the propulsion motor and propeller assembly for steering the watercraft; and a mounting linkage which is attached to the upper portion of the boat for receiving and holding the fixed tube component of the trolling motor assembly. The entire disclosure of U.S. Pat. No. 5,892,338 is incorporated herein by reference. The mounting linkage can be pivoted upwardly for pulling the trolling motor assembly to a stowed position. The trolling motor can be operated by radio frequency remote control or by direct cable connection.

The radio frequency control described in U.S. Pat. No. 5,892,338 includes: a control pad having a plurality of actuatable switches and/or other controls thereon which the user can employ to operate the trolling motor; a radio frequency transmitter unit which is contained within the housing of the remote and which interfaces directly with the user controls; and a receiver unit which is contained within the control head of the trolling motor assembly and which interfaces, via electrical cable, with the propulsion motor electronics in the housing of the propulsion motor and propeller assembly. The transmitter unit contained within the remote control housing comprises a micro-controller, a radio frequency transmitter, conventional support hardware, and a battery. The radio frequency transmitter produces and transmits message packets, each including an address sequence unique to the transmitter and a data sequence corresponding to the user's control command. The radio frequency receiver unit includes a radio frequency receiver circuit, a micro-controller, and appropriate conventional support hardware. The receiver unit decodes the radio frequency commands from the transmitter and produces corresponding output signals effective for controlling the trolling motor assembly. The specific trolling motor assembly functions controlled or provided by the radio frequency system include: propulsion motor on/off; left steering; right steering; propulsion motor speed; constant on or momentary on; high-bypass; verification indicators; and status indicators.

Another radio frequency controller for a trolling motor is described in U.S. Pat. No. 5,859,517, the entire disclosure of which is incorporated herein by reference. U.S. Pat. No. 5,859,517 discloses a compact remote control device which can be placed on the user's finger or on a fishing pole.

U.S. Pat. No. 6,468,117 describes a foot pedal apparatus for controlling a trolling motor. The entire disclosure of U.S. Pat. No. 6,468,117 is incorporated herein by reference. The assembly comprises a foot pedal which is pivotably attached to a base using an offset hinge. The offset hinge includes a detent mechanism which releasably engages when the pedal is moved to a midpoint position. The midpoint position corresponds to a straight ahead steering position of the trolling motor. From the midpoint position, the user will typically push the heel portion of the pedal downward to make a right turn and will push the toe portion of the pedal downward to make a left turn.

SUMMARY OF THE INVENTION

The present invention satisfies the needs and addresses the problems discussed above. The present invention provides a highly maneuverable and versatile system for docking and other operations which can be installed on generally any existing pontoon boat or other craft and does not require any significant modification of the hull or pontoons thereof. The inventive system can be conveniently operated by wireless remote control and will allow even a relatively inexperienced pilot to quickly and safely maneuver and quickly dock the watercraft in congested areas and under adverse conditions.

The inventive docking system employs a plurality of propulsion assemblies which are mounted on the watercraft. If desired, these can be traditional trolling motor assemblies of the type described above. However, each of the propulsion assemblies will preferably be a novel propulsion assembly of a type provided by the present invention. The inventive propulsion assembly is similar to a traditional trolling motor in some respects but is particularly well suited for use in the inventive docking system and for other operations. The inventive propulsion assembly can be quickly attached or removed and can be conveniently moved to a stowed position such that it will not interfere with the normal operation of the craft. The inventive propulsion assembly preferably utilizes a plug and play type connection so that it can be activated or taken out of service as desired without affecting the operation of any of the remaining propulsion assemblies used in the inventive docking system.

In one aspect, there is provided an improved docking system for a watercraft operable on a body of water, the docking system including a plurality of propulsion assemblies which are operable in a coordinated manner effective for steering the watercraft. The improvement comprises (a) each of the propulsion assemblies comprising a steering column and a motor and propeller assembly on a distal end of the steering column and (b) each of the propulsion assemblies being removably mountable in an operating position such that the motor and propeller assembly and the distal end of the steering column will extend into the body of water and the steering column and the motor and propeller assembly can be turned for steering the watercraft.

In another aspect, there is provided an improved watercraft operable on a body of water and having a docking system including a plurality of propulsion assemblies which are operable in a coordinated manner effective for steering the watercraft. The improvement comprises: (a) each of the propulsion assemblies including a steering column and a motor and propeller assembly on a distal end of the steering column and (b) each of the propulsion assemblies having an operating position wherein the motor and propeller assembly and the distal end of the steering column will extend into the body of water and the steering column and the motor and propeller assembly can be rotated for steering the watercraft.

In another aspect, there is provided a propulsion assembly for a watercraft operable on a body of water comprising: a steering column; a motor and propeller assembly on a distal end of the steering column; a steering head, in which a proximal end of the steering column is received, for turning the steering column and the motor and propeller assembly; and a bracket attachable to the watercraft. The steering head is removably connectable to the bracket. The bracket preferably includes a keyhole slot for removably receiving a corresponding attachment member provided on the steering head.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
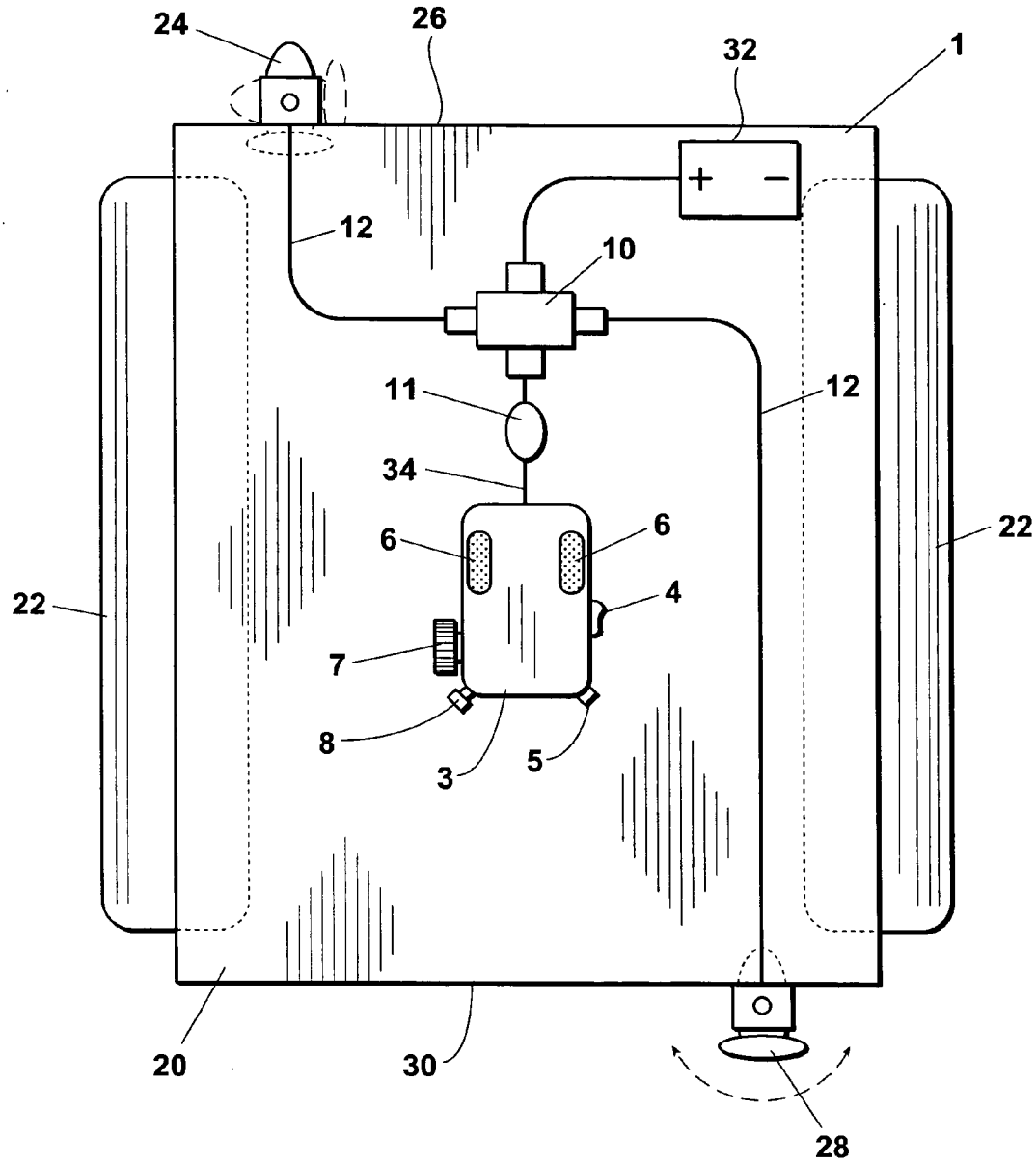
FIG. 1 provides a schematic plan view of a watercraft 1 having an embodiment of the inventive docking system installed thereon.
Figure 2:
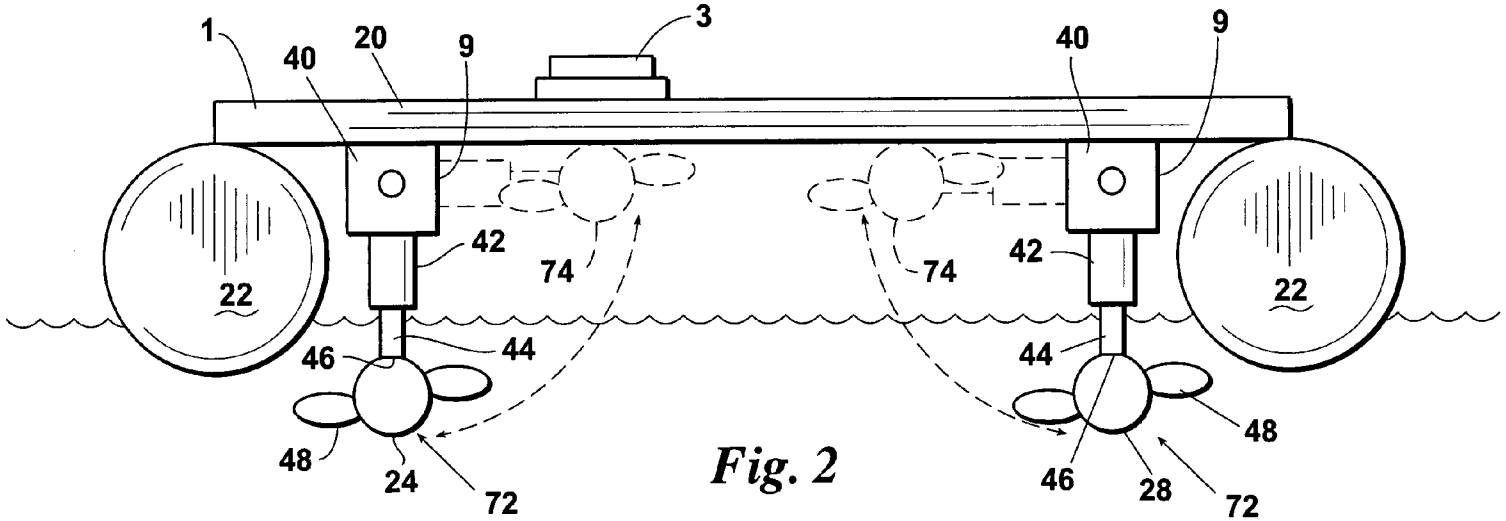
FIG. 2 provides a schematic elevational end view of the watercraft 1.
Figure 7:
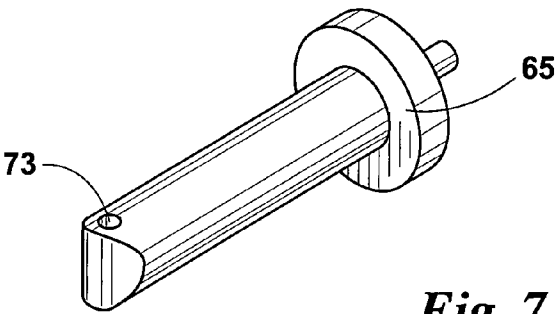
FIG. 7 is a perspective view of a ball detent push pin 65 preferred for use in locking the inventive propulsion assembly 24, 28 on the mounting bracket 50.
Figure 3:
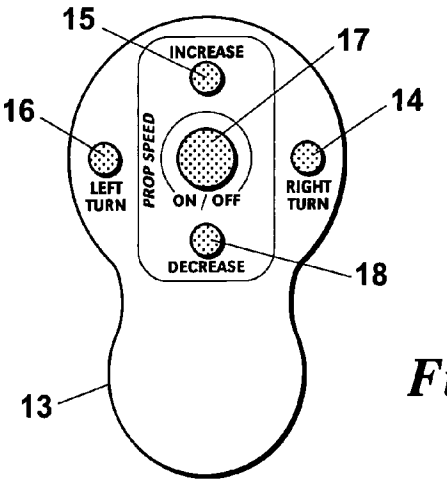
FIG. 3 schematically illustrates a key fob remote control 13 which can be used for controlling the inventive docking system.

An embodiment of the inventive docking system installed on a watercraft 1 is depicted in FIGS. 1–3. The particular watercraft 1 depicted in FIGS. 1 and 2 is a pontoon boat comprising a deck 20 supported on a pair of elongate pontoons 22. It will be understood, however, that the inventive docking system can be installed and used on a deep "V" boat, a deck boat, an amphibious airplane or float plane, or generally any other type of recreational or other watercraft.

The embodiment of the inventive docking system depicted in FIGS. 1–3 comprises: a first propulsion assembly 24 mounted at the bow 26 or other fore portion of the boat deck 20; a second inventive propulsion assembly 28 mounted at the stern 30 or other aft portion of the boat deck 20; a battery or other power source 32; a multi-motor connector 10 for delivering power from power source 32 and control signals to each of the propulsion assemblies 24 and 28; a foot pedal control 3 linked to connector 10 by a cable 34; a radio frequency receiver 11 installed between the foot pedal control 3 and the multi-motor connector 10; a first cable 12 extending from propulsion assembly 24 to the multi-motor connector 10; a second cable 12 extending from propulsion assembly 28 to the multi-motor connector 10; and a radio frequency remote control 13.

Figure 4:
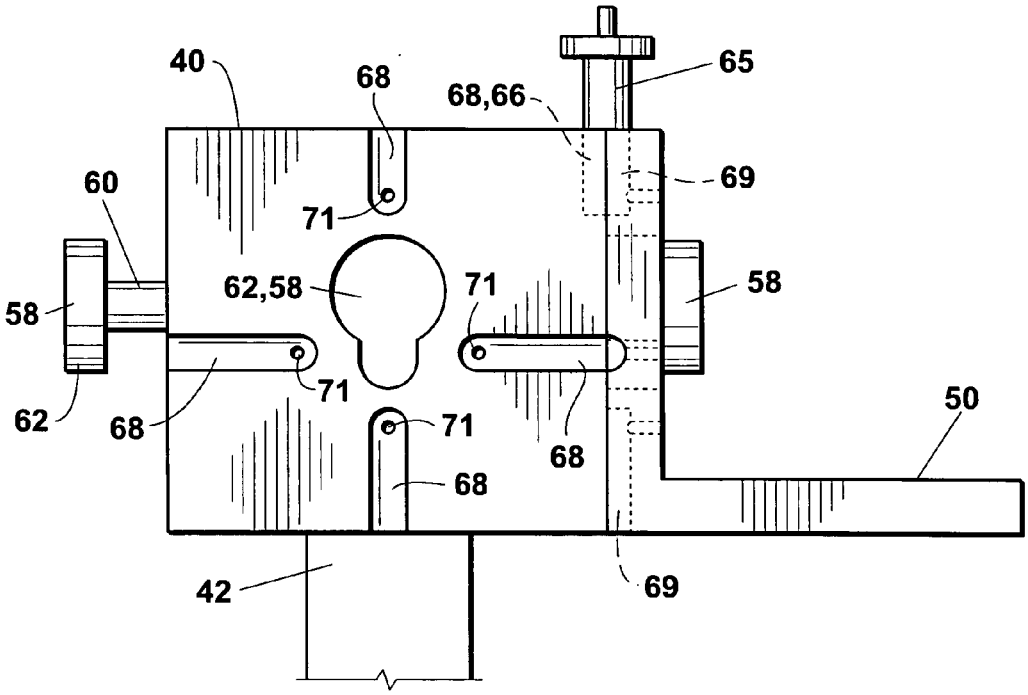
FIG. 4 provides an elevational view of the steering head 40 of an inventive propulsion assembly 24, 28 provided by the present invention removably attached to a novel mounting bracket 50.
Figure 5:
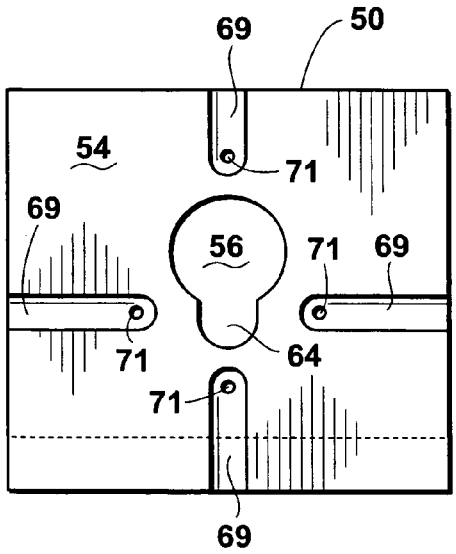
FIG. 5 provides an elevational front view of a mounting bracket 50 for mounting the steering head 40 of the inventive propulsion assembly 24, 28 to the watercraft 1.
Figure 6:
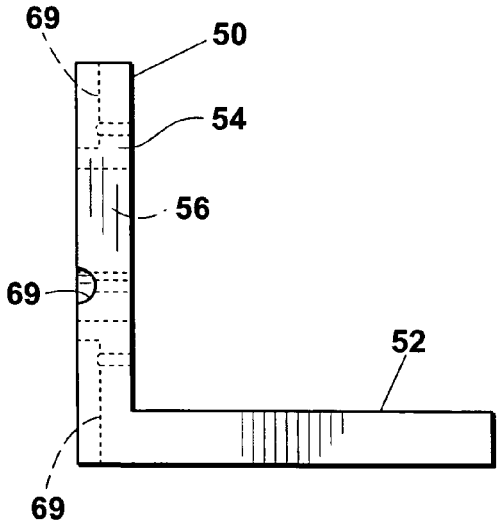
FIG. 6 provides an elevational side view of mounting bracket 50.

Each of the propulsion assemblies 24 and 28 employed in the inventive docking system can generally be any type of traditional trolling motor assembly (such as, e.g., a trolling motor assembly of the type described in U.S. Pat. No. 5,892,338 or U.S. Pat. No. 6,468,117) having a motor and propeller assembly which can be turned in different directional orientations for steering the craft. However, each of the propulsion assemblies 24 and 28 is preferably an inventive propulsion assembly as shown in FIGS. 1, 2, and 4.

As with a traditional trolling motor assembly of the type described in U.S. Pat. No. 5,892,338 or U.S. Pat. No. 6,468,117, the inventive propulsion assembly 24, 28 preferably comprises: a steering head 40; a fixed tube 42 extending downwardly from the bottom of steering head 40; a rotatable steering column 44 which extends through the fixed tube 42 and has an upper proximal end which is received in steering head 40 and a lower distal end 46 which projects from the bottom of the fixed tube 42; and a motor (preferably electric) and propeller assembly 48 secured on the distal end 46 of steering column 44. As used herein and in the claims, the term "propeller" includes propellers, impellers, and any similar type of rotating propulsion structure. The steering head 40 contains a steering motor and appropriate gear assembly for turning the steering column 44 and the motor and propeller assembly 48 in order to steer the watercraft. An electrical cable extends through the rotatable steering column 44 from the steering head 40 to the motor and propeller assembly 48 for activating and for controlling the speed of the propulsion motor.

Unlike a traditional trolling motor assembly, the steering head 40 of the inventive propulsion assembly 24, 28 is preferably configured and adapted for being directly attachable, preferably in a removable manner, to a mounting bracket 50 which can be installed at any convenient location on the watercraft 1. The mounting bracket 50 preferably comprises a mounting plate 52 for attachment to the deck 20 or other portion of the watercraft 1 and a motor plate 54 which extends from the mounting plate and is preferably configured for directly receiving and attaching the steering head 40 of the inventive propulsion assembly. The mounting plate 54 preferably includes a keyhole slot 56 for removably receiving and retaining a correspondingly shaped attachment member 58 which is provided on the exterior of the steering head 40. The attachment member 58 preferably comprises a cylindrical neck portion 60 having an enlarged, flat attachment head 62 on the outer end thereof. The attachment head 62 is sized and configured such that it can be removably inserted into the keyhole slot 56 and will operate to secure the steering head 40 to the motor plate 54 when turned to a rotated position in the keyhole slot 56 and/or when the neck 60 of the attachment member 58 is pushed downward into the narrow lower end 64 of keyhole slot 56.

After the attachment member 58 is positioned in the keyhole slot 56 such that the propulsion assembly 24, 28 is in a desired operating or stowed position, the steering head 40 of the propulsion assembly can be locked in place on the mounting bracket 50, using, for example, a removable ball detent push pin 65. The push pin 65 is inserted into a locking slot 66 formed by a corresponding pair of matching elongate grooves 68 and 69 formed, respectively, in the attachment face of steering head 40 and in the face of the mounting bracket motor plate 54. The elongate grooves 68 and 69 have interior indentations 71 or slots formed therein for removably receiving and retaining the detent ball(s) 73 of the push pin 65. A plurality of appropriately oriented grooves 68 and/or 69 are preferably provided in the steering head attachment face and/or the motor plate 54 for selectively locking the propulsion assembly 24, 28 in different rotated positions for operation and stowing.

As illustrated in FIG. 2, each of the propulsion assemblies 24 and 28 can preferably be positioned in both (a) a deployed operating position 72 wherein the distal end 46 of the steering column 44 and the motor and propeller assembly 48 will be placed in the water and (b) an upward stowed position 74 wherein the motor and propeller assembly 48 will be held out of the water and will not interfere with the normal operation of the watercraft. Moving the propulsion assembly to its stowed position 74 also protects the propulsion assembly from being damaged by drag stresses during normal operation of the watercraft.

The steering head 40 of the inventive propulsion assembly preferably has a rectangular box shape. In addition, each of the four side faces of the box steering head 40 preferably has its own attachment member 58 projecting therefrom and corresponding locking groove(s) 68. The provision of appropriate mounting features on each side of the steering head 40 allows the inventive propulsion assembly to be mounted and used interchangeably at any desired fore, aft, port side, starboard side, or other position on the watercraft.

The embodiment of the inventive docking system illustrated in FIGS. 1 and 2 employs a pair of propulsion assemblies 24 and 28, one of which is preferably mounted at a fore portion 26 of the craft and the other of which is preferably mounted at an aft position 30. Alternatively, the inventive docking system could employ three, four, or more propulsion assemblies. If three propulsion assemblies are used, they will preferably be arranged in a triangular pattern with two of the assemblies being located either at the front or the back of the watercraft. When used on a pontoon boat 1, the trolling assemblies 24 will preferably be mounted to the deck 20 at positions between the longitudinal axes of the pontoons 22 but could alternatively be mounted at positions outside of the longitudinal axes of the pontoons 22. In contrast to the pontoon craft docking systems heretofore known in the art, the propulsion assemblies 24 and 28 of the inventive system are all preferably mounted in positions external to (i.e., not inside of) the pontoons 22. Each of the propulsion assemblies 24 and 28 employed in the inventive system is also preferably capable of turning more than 180° (preferably at least 200°) in either direction. Consequently, the inventive docking system does not require that any of the propulsion assemblies be operated in reverse.

As will be understood by those of ordinary skill in the art, the multi-motor connector 10 employed in the inventive docking system preferably employs simple parallel connections between the connectors such that the same amount of power from the power source 32 and the same control signals from the foot pedal control 3 and/or from the radio frequency remote control 13 are delivered to each of the individual propulsion assemblies 24, 28. The power and control signals are delivered by the electrical cables 12 simultaneously to each of the propulsion assembly steering heads 40 wherein the control signals are implemented in each of the respective propulsion assemblies 24, 28 such that the propulsion assemblies act in coordination with each other to perform the desired docking operation. The propulsion assemblies 24 and 28 will preferably be tuned to operate at equal propulsion speed but could be set to operate at different speeds if desired. It will also be apparent, however, that for steering the watercraft 1 to the right or to the left, the propulsion assembly or assemblies 24 at the front 26 of the craft and the propulsion assembly or assemblies at the back 30 of the craft will turn in opposite directions.

The cables 12 extending from the propulsion assembly steering heads 40 to the multi-motor connector 10 are preferably removably connected to the connector 10 using known plug and play or similar type connections. Consequently, any of the propulsion assemblies 24 or 28 used in the inventive docking system can be unplugged without affecting the operation of any of the other propulsion assemblies 24 or 28 which remain plugged in to the connector 10. As a result, for example, by simply having just one of the propulsion assemblies plugged in to the connector 10, the activated propulsion assembly can be operated and used in the same manner as a traditional trolling motor. The plug and play connections also facilitate the interchangeable use of the inventive propulsion assemblies at different locations and further allows each propulsion assembly to be conveniently removed for storage elsewhere.

The foot pedal control 3 employed in the inventive docking system can generally be any type of foot pedal control device used in the art. The foot pedal control device 3 will most preferably be an offset hinge pedal assembly of the type described in U.S. Pat. No. 6,468,117. As will be understood by those in the art, the foot pedal control 3 preferably includes: an on/off switch 4; a knurled wheel 7 for adjusting the operating speed of the propulsion assemblies 24 and 28; a power on or constant on switch 8 which operates to power up all of the propulsion assemblies 24 and 28; at least a pair of momentary on/off switches 6 which can be depressed for, e.g., activating or deactivating only one of the trolling assemblies 24 or 28 or for activating or deactivating all of the trolling assemblies on either the port side or the starboard side of the craft.

If the pilot desires to use only one motor to spin the boat, make minor adjustments in any direction, or make minor adjustments in speed, then either of the momentary on/off switches 6 can be depressed. If the constant on switch 8 is off, then depressing one of the momentary on/off switches 6 will activate the particular propulsion assembly or assemblies corresponding thereto. If the constant on switch 8 is on, depressing one of the momentary on/off switches will operate to stop the propulsion assembly or assemblies corresponding thereto. For safety purposes, it will preferably be necessary that the momentary on/off switch be quickly tapped twice in order to turn the motor(s) back on.

As described in U.S. Pat. No. 6,468,117, the foot pedal preferably has a centered position which corresponds to a straight ahead orientation of the boat and the foot pedal will preferably be capable of rotating 15° up and 15° down from the centered position (i.e., a combined arc range of 30°). As mentioned above, each of the propulsion motor and propeller assemblies will preferably be capable of rotating both 200° clockwise and 200° counterclockwise, totaling 400°. Consequently, there is a direct relationship between the foot pedal position and the propulsion assembly position wherein each 1° change in the position of the foot pedal produces a 13.33° change in the rotational position of each propulsion assembly 24 and 28.

Similar to the foot pedal control 3, the remote control device 13 employed in the inventive system preferably comprises: a right turn button 14; a left turn button 16; a prop speed increase button 15; a prop speed decrease button 18; and an on/off button 17. The radio frequency remote control operates in generally the same manner as the radio frequency control device described in U.S. Pat. No. 5,892,338 or in U.S. Pat. No. 5,859,517. For convenience, the remote control will preferably be in the form of a key fob device similar to those commonly used for automobile keyless entry systems. It will also be understood by those in the art that, although a radio frequency transmitter is preferred, the remote control could alternatively employ an infrared transmitter or any other type of wireless transmission system known in the art.

The control signals produced by both the foot pedal control 3 and the remote control 13 are each received by the receiver unit 11. As with the prior art foot pedal and remote control systems discussed above, the foot pedal 3 and the remote control 13 each transmit control signals comprising a transmission source identification sequence and a control data sequence. In the inventive system, the foot pedal 3 will preferably be the master control which will override the remote control 13 in the event that the user happens to operate both the foot pedal 3 and the remote control 13 simultaneously.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a docking system for a watercraft operable on a body of water, said docking system including a plurality of propulsion assemblies which are operable in a coordinated manner effective for steering said watercraft, the improvement comprising;

each of said propulsion assemblies comprising a steering column and a motor and propeller assembly on a distal end of said steering column;

each of said propulsion assemblies being removably mountable in an operating position such that said motor and propeller assembly and said distal end of the steering column will extend into said body of water and said steering column and said motor and propeller assembly can be turned for steering said watercraft;

each of said propulsion assemblies further including a steering head, from which said steering column rotatable extends, for turning said steering column and said motor and propeller assembly to steer said watercraft;

each said steering head being removably mountable on said watercraft in said operating position such that said steering head will remain in fixed position with respect to said watercraft as said steering column and said motor and propeller assembly are turned for steering said watercraft;

a plurality of brackets which can be secured to said watercraft and to which said steering heads are directly attachable; and each of said brackets including a keyhole slot for removably receiving a corresponding attachment member provided on said steering head.

2. The docking system of claim 1 wherein the improvement further comprises at least one of said propulsion assemblies being removably mountable to an aft portion of said watercraft and at least one of said propulsion assemblies being removably mountable to a fore portion of said watercraft.

3. The docking system of claim 2 wherein said watercraft comprises a deck supported by at least two pontoons and wherein the improvement further comprises each of said propulsion assemblies being removably mountable in said operating position such that said propulsion assemblies are external to said pontoons.

4. The docking system of claim 1 wherein the improvement further comprises each of said propulsion assemblies also being placeable in a stowed position mounted to said deck wherein said steering column and said motor and propeller assembly will not extend into said body of water.

5. The docking system of claim 1 wherein the improvement further comprises said steering head being movable from said operating position to a stowed position wherein said attachment member is received in said keyhole slot and wherein said steering column and said motor and propeller assembly will not extend into said body of water.

6. The docking system of claim 1 wherein the improvement further comprises:

at least one user interface for sending watercraft steering signals; and a splitter which will receive said watercraft steering signals and direct said watercraft steering signals to said steering head of each of said propulsion assemblies in a manner effective for a coordinated operation of said propulsion assemblies to steer said watercraft.

7. The docking system of claim 6 wherein the improvement further comprises:

said user interface being operable for sending watercraft speed signals to said splitter and said splitter being effective for directing said watercraft speed signals to each said steering head.

8. The docking system of claim 6 wherein the improvement further comprises said splitter being effective for directing electrical power to each of said propulsion assemblies.

9. The docking system of claim 6 wherein the improvement further comprises said user interface being a key fob remote control.

10. The docking system of claim 6 wherein the improvement further comprises each of said propulsion assemblies further including an electrical cable extending from said steering head which can be selectively connected to and disconnected from said splitter such that, when any of said propulsion assemblies is disconnected from said splitter, each of said propulsion assemblies which remains connected to said splitter will continue to operate.

11. In a watercraft operable on a body of water and having a docking system including a plurality of propulsion assemblies which are operable in a coordinated manner effective for steering said watercraft, the improvement comprising:

each of said propulsion assemblies including a steering column and a motor and propeller assembly on a distal end of said steering column;

each of said propulsion assemblies having an operating position wherein said motor and propeller assembly and said distal end of said steering column will extend into said body of water and wherein said steering column and said motor and propeller assembly can be turned for steering said watercraft;

each of said propulsion assemblies further including a steering head, from which said steering column rotatably extends, for turning said steering column and said motor and propeller assembly to steer said watercraft; and a plurality of brackets to which said steering heads are removably attachable, each of said brackets including a keyhole slot for receiving a corresponding attachment member provided on said steering head.

12. The watercraft of claim 11 wherein said watercraft comprises a deck supported by at least two pontoons and wherein the improvement further comprises each of said propulsion assemblies being external to said pontoons.

13. The watercraft of claim 12 wherein the improvement further comprises at least one of said propulsion assemblies being mounted to an aft portion of said deck and at least one of said propulsion assemblies being mounted to a fore portion of said deck.

14. The watercraft of claim 12 wherein the improvement further comprises each of said propulsion assemblies being movable to a stowed position wherein it is mounted to said deck but said steering column and said motor and propeller assembly will not extend into said body of water.

15. The watercraft of claim 11 wherein the improvement further comprises:

each of said propulsion assemblies further including a steering head for turning said steering column and said motor and propeller assembly to steer said watercraft;

at least one user interface for sending watercraft steering signals; and a splitter which will receive said watercraft steering signals and direct said watercraft steering signals to said steering head of each of said propulsion assemblies in a manner effective for a coordinated operation of said propulsion assemblies to steer said watercraft.

16. The watercraft of claim 15 wherein the improvement further comprises:

said user interface being operable for sending watercraft speed signals to said splitter and said splitter being effective for directing said watercraft speed signals to each said steering head.

17. The watercraft of claim 15 wherein the improvement further comprises said splitter being effective for directing electrical power to each of said propulsion assemblies.

18. The watercraft of claim 15 wherein the improvement further comprises said user interface being a key fob remote control.

19. The watercraft of claim 15 wherein the improvement further comprises each of said propulsion assemblies further including an electrical cable extending from said steering head which can be selectively connected to and disconnected from said splitter such that, when any of said propulsion assemblies is disconnected from said splitter, each of said propulsion assemblies which remains connected to said splitter will continue to operate.

20. A propulsion assembly for a watercraft operable on a body of water comprising:

a steering column;

a motor and propeller assembly on a distal end of said steering column;

a steering head, in which a proximal end of said steering column is received, for turning said steering column and said motor and propeller assembly, said steering head having at least three side faces; and a bracket attachable to said watercraft, wherein each of said three side faces of said steering head is adapted to be selectively and removably mounted directly on said bracket.

21. The propulsion assembly of claim 20 wherein said steering head has a rectangular box shape with four of said side faces and wherein each of said side faces is selectively and removably connectable directly to said bracket.

22. The propulsion assembly of claim 20 wherein said bracket includes a keyhole slot for selectively and removably receiving correspondingly-shaped attachment members protecting from said three side faces of said steering head.

23. The propulsion assembly of claim 22 wherein each of said attachment members can be rotated in said keyhole slot such that, when any one of said three side faces is connected to said bracket, said steering head is moveable from an operating position wherein said motor and propeller assembly will extend into said body of water to a stowed position wherein said motor and propeller assembly will be positioned out of said body of water.

24. The propulsion assembly of claim 20 further comprising:

at least one bracket groove provided in said bracket;

at least one corresponding groove provided in each of said three side faces of said steering head such that each said corresponding groove is positionable adjacent to said bracket groove to form an attachment slot; and a locking pin removably insertable in said attachment slot for locking said steering head in place on said bracket.

25. The propulsion assembly of claim 24 wherein said locking pin is a ball detent pin and said attachment slot is a corresponding ball detent slot.

26. In a docking system for a watercraft operable on a body of water, said docking system including a plurality of propulsion assemblies which are operable in a coordinated manner effective for steering said watercraft, the improvement comprising;

each of said propulsion assemblies comprising a steering column and a motor and propeller assembly on a distal end of said steering column;

each of said propulsion assemblies being removably mountable in an operating position such that said motor and propeller assembly and said distal end of the steering column will extend into said body of water and said steering column and said motor and propeller assembly can be turned for steering said watercraft;

each of said propulsion assemblies further including a steering head for turning said steering column and said motor and propeller assembly to steer said watercraft;

at least one user interface for sending watercraft steering signals;

a splitter which will receive said watercraft steering signals and direct said watercraft steering signals to said steering head of each of said propulsion assemblies in a manner effective for coordinated operation of said propulsion assemblies to steer said watercraft;

said user interface being a key fob remote control; and a foot pedal control device which will override said key fob remote control.

27. In a watercraft operable on a body of water having a docking system including a plurality of propulsion assemblies which are operable in a coordinated manner effective for steering said watercraft, the improvement comprising:

each of said propulsion assemblies including a steering column and a motor and propeller assembly on a distal end of said steering column;

each of said propulsion assemblies having an operating position wherein said motor and propeller assembly and said distal end of said steering column will extend into said body of water and wherein said steering column and said motor and propeller assembly can be turned for steering said watercraft;

each of said propulsion assemblies further including a steering head for turning said steering column and said motor and propeller assembly to steer said watercraft;

at least one user interface for sending watercraft steering signals;

a splitter which will receive said watercraft steering signals and direct said watercraft steering signals to said steering head of each of said propulsion assemblies in a manner effective for a coordinated operation of said propulsion assemblies to steer said watercraft;

said user interface being a key fob remote control; and a foot pedal control device which will override said key fob remote control.

28. In a docking system for a watercraft operable on a body of water, said docking system including a plurality of propulsion assemblies which are electrically powered and are operable in a coordinated manner effective for steering said watercraft, the improvement comprising:

each of said propulsion assemblies comprising a steering column and a motor and propeller assembly on a distal end of said steering column;

each of said propulsion assemblies being removably mountable in an operating position such that said motor and propeller assembly and said distal end of the steering column will extend into said body of water and said steering column and said motor and propeller assembly can be turned with respect to a steering head of each of said propulsion assemblies for steering said watercraft;

an electrical power source; and a splitter, each of said propulsion assemblies being electrically connectable to and disconnectable from said splitter, wherein said splitter will deliver electrical power from said electrical power source to each of said propulsion assemblies and said splitter will receive watercraft steering signals and will direct said watercraft steering signals to each of said propulsion assemblies in a manner effective to provide a coordinated operation of all of said propulsion assemblies for docking said watercraft;

wherein, when any of said propulsion assemblies is disconnected from said splitter, said splitter will still deliver said electrical power and will direct said watercraft steering signals to each of said propulsion assemblies which remains connected to said splitter in a manner effective such that each of said propulsion assemblies will continue to operate for docking said watercraft; and wherein, by disconnecting all except one of said propulsion assemblies from said splitter, said splitter will still deliver said electrical power and will direct said watercraft steering signals to said one propulsion assembly in a manner effective for using said one propulsion assembly as a trolling motor for a trolling operation of said watercraft.

29. The docking system of claim 28 wherein the improvement further comprises at least a first of said propulsion assemblies being removably mountable to an aft portion of said watercraft and at least a second of said propulsion assemblies being removably mountable to a fore portion of said watercraft.

30. The docking system of claim 29 wherein said watercraft comprises a deck supported by at least two pontoons and wherein the improvement further comprises each of said propulsion assemblies being removably mountable in said operating position such that said propulsion assemblies are external to said pontoons.

31. The docking system of clam 28 wherein the improvement further comprises a foot pedal for sending said watercraft steering signals to said splitter, wherein:

said foot pedal includes a first monetary on/off control for selectively deactivating or activating at least a first of said propulsion assemblies;

said foot pedal includes a second momentary on/off control for selectively deactivating or activating at least a second of said propulsion assemblies;

when either of said first or said second propulsion assemblies is deactivated by operation of said first or said second momentary on/off control, each of said propulsion assemblies which remains activated will continue to operate for docking said watercraft.

* * * * *